United States Patent [19]

Garcia Pastor et al.

[11] Patent Number: 4,949,471

[45] Date of Patent: Aug. 21, 1990

[54] MECHANICAL DRYING PROCESS APPLICABLE TO PAPERMAKING

[76] Inventors: Daniel Garcia Pastor; Francisco Garcia Pastor, both of Burriana, 19, 46005 Valencia, Spain

[21] Appl. No.: 343,677

[22] Filed: Apr. 27, 1989

[30] Foreign Application Priority Data

Aug. 17, 1988 [ES] Spain ..... 8802555

[51] Int. Cl.[5] ..... F26B 3/00

[52] U.S. Cl. ..... 34/23; 34/111; 34/123

[58] Field of Search ..... 34/113, 111, 114, 115, 34/116, 117, 123, 23, 69

[56] References Cited

U.S. PATENT DOCUMENTS 4,710,271 12/1987 Miller ..... 34/116 X

*Primary Examiner*—Henry A. Bennet
*Assistant Examiner*—John Sollecito
*Attorney, Agent, or Firm*—Zarley, McKee, Thomte, Voorhees & Sease

[57] ABSTRACT

The present invention is to be used in drying installations. The invention consists of combining the heat of the copper cylinders on which the paper slides with pressing rollers with a diameter larger than the conventional rollers used to transport the belt which guides the sheet of paper. The invention has been foreseen to increase the number of pressure points by installing other pressing rollers at the free spaces, accelerating the drying process.

6 Claims, 1 Drawing Sheet

MECHANICAL DRYING PROCESS APPLICABLE TO PAPERMAKING

OBJECT OF THE INVENTION

The invention relates to a mechanical drying process applicable to papermaking, through which higher efficiency is obtained in the drying, and an important energy savings is obtained.

BACKGROUND OF THE INVENTION

In the papermaking industry, the drying batteries represent, within the installations, the highest and most costly energy consumption (thermal energy) of the manufacturing process.

The elimination of water in the papermaking process has been accomplished by three different ways, depending on the physicomechanical state of the sheet.

In the first step, the sheet has some very weak mechanical features or properties, thus the removal of water is by filtration over a continuous mesh. In other words, the water abandons the sheet by gravity or natural dripping, escaping between the tangle that the cellulose fibers form.

In the second state of the process, the sheet is more resistant and is subjected to different successive pressings whose pressure values are progressive. The limit of water removed in this state has been marked for years by the resistance itself of the sheet with regard to high pressures. Thus the pressing action managed to achieve moisture limits in the sheet from 6.0 to 56%.

Recent technological advances in pressing have made it possible to reduce this index and approach values of 50%.

Any present system fails in obtaining a greater dryness of the sheet.

In the conventional techniques used for the drying of paper, the elimination of water in the sheet is accomplished by evaporation, by means of a battery of drying drums heated inside by steam at pressures which vary between 0–8M $P/M^2$.

The sheet of paper is led through the dryers, remaining in contact with their surface, permitting the evaporation of the water contained in the paper upon producing a heat transfer from the surface of the dryer to the sheet of paper.

Independent of other existing drying systems (drying tunnels) the sequence of water contained in the sheet, depending on the type of paper and manufacturing method, is approximately the following:

| PROCESS | WATER FOUND IN THE SHEET |
|---|---|
| Formation: | 99% |
| Entry into the pressing system | 80% |
| Emergency from the pressing system and entry into the drying installation | 55–50% |

BRIEF DESCRIPTION OF THE INVENTION

The mechanical drying process of the present invention combines the effects of pressure and temperature for the purpose of reducing the energy cost of the elimination of water.

The drying mechanism basically consists of one or more hollow central cylinders with a variable diameter.

The type of use of this system determines the cylinder diameter and number thereof.

The geometry of the equipment, as well as the number of pressing rollers, is dependent upon the installation design and the use of the system.

The central cylinder or base cylinder is heated inside by different conventional means (steam, gas and others) so that the surface thereof reaches the highest possible temperature which vary between 100° and 450° C.

The pressing rollers act against the base cylinder with high pressures of 150 to 350 KN/m., which are in turn endured by the porous structure of the sheet of paper.

As contrasted with the conventional pressing system this process introduces the new component that is temperature, and begins to treat the sheet after the moisture content has been reduced approximately 50%.

The invention also introduces the component of pressure which does not exist in the present drying installations.

The sheet of paper to be treated with this process should have a moisture equal to or less than 50%, which permits a severe treatment thereof as far as pressure and temperature are concerned.

The speed of the machine makes the contact time of the sheet with the cylinder or drying drum very short, thus the transmission of heat is slight. A large number of drying cylinders is needed so that the sheet reaches a temperature which permits the water to vaporize.

Upon subjecting the sheet to a high pressure over a highly heated cylinder, the transmission of heat is instantaneous. This phenomenon is favored as the time under pressure of the sheet increases, hence the proposed system considers base cylinders and presses with a large diameter. In turn, this permits distribution of the pressure which avoids the deterioration of the sheet.

The calories absorbed by the sheet permit the combination of two effects, whose purpose is to eliminate water. On the one hand, the water undergoes a reduction of viscosity which allows it to flow more easily and thus prolong the effects of the traditional pressing action. Thus, there is elimination of water by pressure. On the other hand, the water reaches its evaporation temperature very rapidly, producing a higher yield of the drying method by contact. Thus, there is elimination of water by evaporation.

The system modifies the present concepts of machines in this drying area, obtaining smaller investments and important energy savings in the drying of the sheet, in the elimination of water from 50 to 7%.

BRIEF DESCRIPTION OF THE DRAWINGS

For a better understanding of what has been put forth, the present specification is accompanied by drawings on which the following has been represented.

DESCRIPTION OF A PREFERRED EMBODIMENT

In accordance with the drawings, the rotatable main cylinders -1- are highly heated by steam, gas or another means, upon whose periphery act the pressing rollers -3- which are of a larger size than the rollers -2- used in the conventional drying installation.

As it has already been said above, these rollers -3- exert on each one of the cylinders a strong pressure, which in combination with the heat that the main cylinders receive determines the drying of the sheet of paper.

Figure 2:
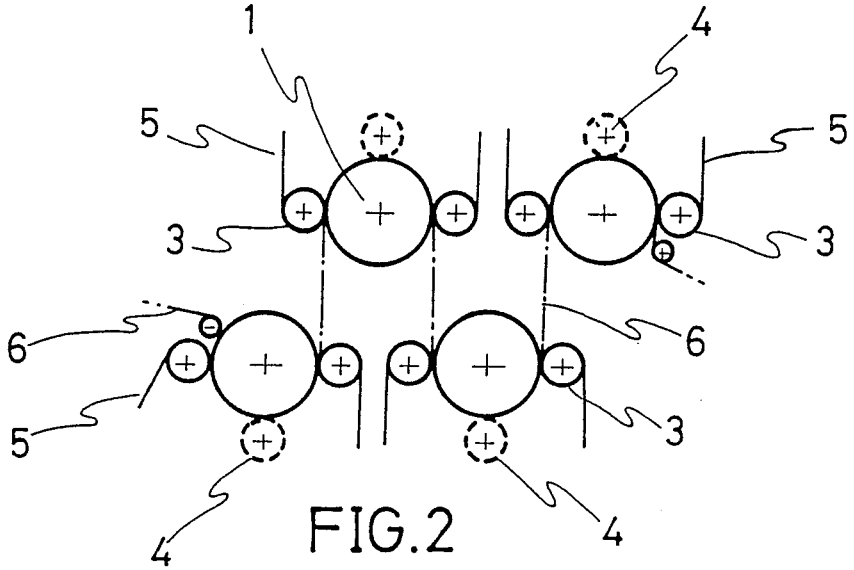
FIG. 2. A detailed sketch of one part of a drying installation in accordance with the invention.

Independent of replacing the conventional rollers by others of a larger size, the increasing of the number of pressure cylinders around the main cylinder, such as shown with -4- in dashed line FIG. 2, is provided.

Figure 1:
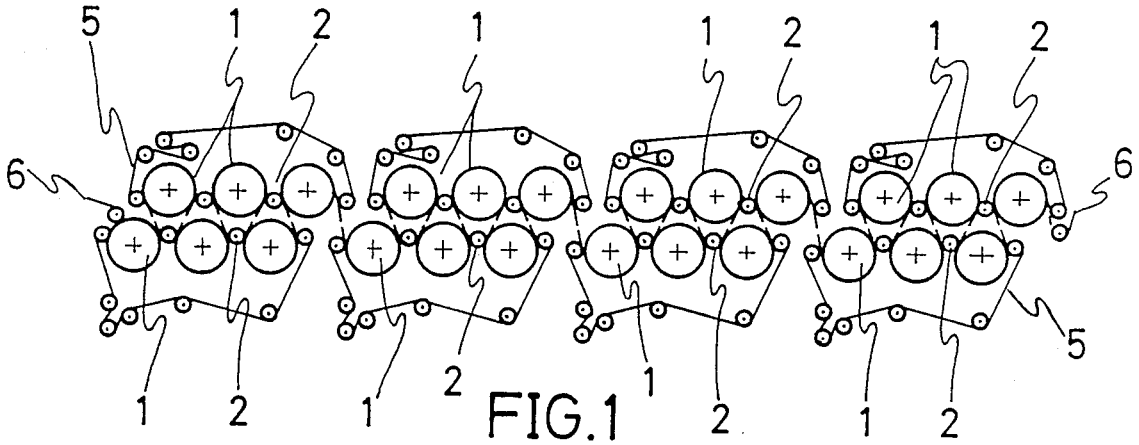
FIG.1 (PRIOR ART)
FIG. 1. A detailed sketch of one part of a conventional type drying installation.

As is shown in the drawings, the conventional drag rollers of the belt -5- which holds the sheet of paper -6- (FIG. 1) have been replaced by other rollers -3- of a larger diameter which in turn carry out the function of the former, and are pressing elements of the sheet of paper against the heated roller -1- (FIG. 2).

The arrangement of these pressing rollers will generally be in diametral opposition just as appears in said FIG. 2, though, as has been represented and described in the dashed line, there is the possibility of situating other rollers -4- which do not coincide with the diametral position of the rollers -3-.

We claim:

1. An improved mechanical drying process applicable to papermaking, which is used in drying installations made up of a heated large diameter cylinder, over whose surface moves a sheet of paper guided by guide rollers, said guide rollers also guiding the movement of a guide belt over the cylinder surface such that paper is pressed between the belt and the cylinder surface, the improvement comprising:

applying pressure against the belt, paper and cylinder surface with a pressing roller, said pressing roller being independent from any guiding movement of the paper and belt, whereby combining the pressure and heat accelerates and increases the extent of the drying.

2. The mechanical drying process applicable to papermaking, in accordance with claim 1, characterized by the guide rollers replacing and have a larger diameter than the conventional drag rollers of the belt.

3. The mechanical drying process applicable to papermaking, in accordance with claim 1, characterized by the arrangement of the guiding rollers in points diametrically opposite the cylinder.

4. The mechanical drying process applicable to paper making, according to claim 1, characterized by the arrangement of the pressing roller in a position not coinciding with the guiding rollers.

5. The mechanical drying process of claim 1 wherein the pressing roller applies pressure greater than that exerted by the guide rollers.

6. An improved machine for drying a sheet of paper, the machine having a heated drum with an outer surface, a plurality of guide rollers, and a guide belt trained about the guide rollers and drum, the paper being movably pressed between the guide belt and drum surface, the improvement comprising:

a pressure roller mounted adjacent the drum surface so as to exert additional pressure on the belt and paper against the drum surface so as to accelerate and increase the extent of drying, the pressure roller being independent from the guidance of the belt or paper.

* * * * *